US008695510B2

(12) United States Patent
Johnson et al.

(10) Patent No.: US 8,695,510 B2
(45) Date of Patent: Apr. 15, 2014

(54) TABLE WITH STORABLE MONITOR

(75) Inventors: Ross Johnson, Jenison, MI (US); Bryan Gingrich, Holland, MI (US)

(73) Assignee: Haworth, Inc., Holland, MI (US)

( * ) Notice: Subject to any disclaimer, the term of this patent is extended or adjusted under 35 U.S.C. 154(b) by 280 days.

(21) Appl. No.: 13/200,277

(22) Filed: Sep. 22, 2011

(65) Prior Publication Data

US 2012/0312199 A1 Dec. 13, 2012

Related U.S. Application Data

(60) Provisional application No. 61/520,523, filed on Jun. 10, 2011.

(51) Int. Cl.
*A47B 37/00* (2006.01)

(52) U.S. Cl.
USPC ..... 108/50.02; 108/50.11

(58) Field of Classification Search
USPC ..... 312/7.2, 223.3, 223.6, 246, 330.1, 196, 312/319.2, 323, 334.7; 108/50.02, 50.01, 108/50.11, 143, 25, 26; 248/298.1, 286.1, 248/241
See application file for complete search history.

(56) References Cited

U.S. PATENT DOCUMENTS

| | | | |
|---|---|---|---|
| 1,518,881 | A | 12/1924 | Walker et al. |
| 2,117,928 | A | 5/1938 | Wardell |
| 2,157,887 | A | 5/1939 | Davis |
| 2,225,859 | A | 12/1940 | Cox |
| 2,820,112 | A | 1/1958 | Lupu |
| 2,984,714 | A | 5/1961 | Kunkle |
| 3,180,585 | A | 4/1965 | Pusey et al. |
| 3,427,719 | A | 2/1969 | Gordon et al. |
| 3,429,516 | A | 2/1969 | Sharp et al. |
| 3,514,171 | A | 5/1970 | McGaha |
| 4,174,816 | A | 11/1979 | Olson |
| 4,735,467 | A | 4/1988 | Wolters |
| 4,766,422 | A | 8/1988 | Wolters et al. |
| 5,117,859 | A | 6/1992 | Carlson |
| 5,156,349 | A | 10/1992 | Wilson et al. |
| 5,388,032 | A | 2/1995 | Gill et al. |

(Continued)

FOREIGN PATENT DOCUMENTS

JP 2002347474 * 12/2002

OTHER PUBLICATIONS c:scape & media:scape Specification Guide, media:scape Table, 7 pages, unknown date.

(Continued)

*Primary Examiner* — Janet M Wilkens
(74) *Attorney, Agent, or Firm* — Warner Norcross & Judd LLP

(57) ABSTRACT

A table arrangement having a guide rail structure secured to the table adjacent the underside of the table top. A carriage is movable along a guide structure from a retracted position under the table top to an extended position disposed adjacent one table edge. A supporting frame is hingedly carried on the carriage and mounts a flat-panel video monitor thereon, the latter being storable directly under the table top when the carriage is in the retracted position. Movement of the carriage to the extended position causes the supporting frame and monitor to project beyond the adjacent table edge, whereupon the supporting frame and monitor can be swung upwardly about the hinge axis into an upright use position wherein the monitor protrudes above the table top adjacent the one edge, and the monitor screen fronts onto the region above the table top.

1 Claim, 16 Drawing Sheets

(56) References Cited

U.S. PATENT DOCUMENTS

| | | | | |
|---|---|---|---|---|
| 5,593,116 | A | 1/1997 | Pettesch et al. | |
| 5,775,354 | A | 7/1998 | Upton | |
| 5,797,666 | A | 8/1998 | Park | |
| 5,829,130 | A * | 11/1998 | Miller | 29/868 |
| 6,075,504 | A | 6/2000 | Stoller | |
| 6,092,883 | A | 7/2000 | Lechman | |
| 6,142,590 | A | 11/2000 | Harwell | |
| 6,168,250 | B1 | 1/2001 | Rogov | |
| 6,442,030 | B1 | 8/2002 | Mammoser et al. | |
| 6,474,760 | B2 | 11/2002 | Rauls | |
| 6,553,919 | B1 | 4/2003 | Nevin | |
| 6,609,465 | B2 | 8/2003 | Kolavo | |
| 6,626,686 | B1 | 9/2003 | D'Souza et al. | |
| 6,802,577 | B2 | 10/2004 | Gershfeld | |
| 6,827,409 | B2 | 12/2004 | Michael | |
| 6,913,332 | B1 | 7/2005 | Besterfield et al. | |
| 6,945,412 | B2 | 9/2005 | Felcman et al. | |
| D510,821 | S | 10/2005 | Madison | |
| 6,956,735 | B2 | 10/2005 | Lee et al. | |
| 6,960,098 | B1 * | 11/2005 | Tseng | 439/502 |
| D521,770 | S | 5/2006 | Madison | |
| 7,047,890 | B2 | 5/2006 | Korber et al. | |
| 7,063,024 | B2 | 6/2006 | Latino | |
| 7,077,650 | B2 | 7/2006 | Johnstone | |
| 7,187,554 | B2 | 3/2007 | Seki et al. | |
| 7,207,278 | B2 | 4/2007 | Latino et al. | |
| 7,258,568 | B2 | 8/2007 | Shih | |
| 7,509,912 | B2 | 3/2009 | Stengel et al. | |
| 7,748,328 | B2 | 7/2010 | Horton | |
| 7,755,904 | B2 | 7/2010 | Wu et al. | |
| 2002/0109445 | A1 * | 8/2002 | Sears | 312/319.2 |
| 2002/0149706 | A1 * | 10/2002 | Rosen | 348/794 |
| 2006/0117669 | A1 | 6/2006 | Baloga et al. | |
| 2006/0150869 | A1 * | 7/2006 | Cvek | 108/25 |
| 2009/0151606 | A1 | 6/2009 | Korber et al. | |
| 2009/0260547 | A1 | 10/2009 | Epstein et al. | |
| 2010/0302454 | A1 | 12/2010 | Epstein et al. | |

OTHER PUBLICATIONS

Extron® Electronics, Cable Cubby® Surface-Mountable Enclosures for Cables, A/V, Data and AC Power Connections brochure, 6 pages, 2007.

Extron® Electronics Interfacing, Switching and Control, Retractor brochure, 2 pages, 2009.

* cited by examiner

TABLE WITH STORABLE MONITOR

CROSS REFERENCE TO RELATED APPLICATIONS

This claims the benefit of U.S. Provisional Application No. 61/520,523, filed Jun. 10, 2011, the disclosure of which is hereby incorporated by reference in its entirety.

FIELD OF THE INVENTION

This invention relates to a table arrangement, such as a conference table, and specifically an improved table arrangement having a video monitor mounted thereon and movable between a hidden storage position below the table top and an upright use position adjacent an edge of the table to facilitate connection to and control by a laptop computer positioned on the table.

BACKGROUND OF THE POSITION

Offices in commercial buildings, and specifically conference rooms or small meeting rooms, are frequently equipped with a fairly large video monitor to permit visual display of information to a plurality of people disposed within the room, which people are frequently seated around a fairly large-sized conference table. The video monitor, which in recent years is typically of the flat panel type, is normally mounted on a wall or suspended from the ceiling, although frequently the monitor may be mounted on a separate credenza or mobile cart. In all such instances the monitor is mounted separate from, and frequently significantly spaced from, the conference table and the individuals seated therearound. This remote spacing and the specific location of the monitor makes connection of the monitor to a laptop computer inconvenient and in many cases difficult, thereby making control over the video display more difficult, and frequently resulting in loose cables extending across the floor so as to create a potential safety hazard. In some instances special conference tables have been developed which have a cable module fixed thereto, and which may also or alternately have a cable trough extending therealong into which cables project up from the floor and extend into the trough. These cable troughs will frequently contain elongate lengths of connecting cables therein so that individuals adjacent the table can reach into the trough and pull out a length of cable for connection to a laptop computer. While such has arrangements have improved the accessibility of the cables to the computer and have improved the control of the cables adjacent the table, they nevertheless have required special modification of the table structure, particularly the upper surface, and the overall situation still requires extension of cables to a remote monitor location.

While tables or desks have been developed which incorporate a monitor thereon, these are typically structurally complex and/or involve the use of storage recesses or compartments which significantly impede the overall flexible use of the table.

Examples of prior table and desk constructions are illustrated by the following patents and publications: U.S. Pat. Nos. 7,748,328, 7,509,912, 7,207,278, 7,063,024, 7,047,890, 6,913,332, 6,609,465, 6,168,250, 4,766,422, 2006-011769, 2009-0260547, 2010-03022454.

The use of video monitors within conference and meeting rooms, and specifically the connection of cabling between the monitor and a computer or electronic device positioned on a table, continues to present a problem which has been less than optimally resolved.

Accordingly, it is an object of the present invention to provide an improved table arrangement which overcomes the disadvantages discussed above by mounting a monitor directly on the table while at the same time facilitating the connection of both power and computer cables to the monitor without having to string unnecessary cables across the floor or across long distances, and providing improved visual observation of the monitor by positioning it in close association to individuals seated around the table.

More specifically, in accordance with the present invention, the table arrangement mounts a support structure on an underside of the table top, which support structure slidably mounts a carriage for horizontal movement beneath the table top between extended and retracted positions. The carriage couples to a monitor support through a horizontal hinge arrangement, which support mounts a conventional flat-panel video monitor thereon. The monitor and its support are oriented generally horizontally and disposed substantially entirely below the table top in a generally hidden storage position when the carriage is in its retracted position. When the monitor and its support are moved outwardly to extend beyond an adjacent edge of the table, such as by pulling on the monitor support so as to move the carriage horizontally along the underside of the table top to its extended position, the monitor can then be manually pivoted upwardly about the hinge connection so that the monitor assumes an upright position disposed adjacent and projecting upwardly from an edge of the table top, thereby providing for clear and close visual proximity of the monitor to the individuals seated at the table. Power is supplied to the monitor through a cable which extends through a horizontally movable cable manager which connects between the carriage and the table top to maintain the cable hidden and close to the underside of the table top, while at the same time compensating for the movement of the monitor between its stored and upright use positions. The cable then extends along the underside of the table to a table leg, and then downwardly for connection to a suitable floor-mounted power receptacle. The regions adjacent and under the table are hence maintained reasonably free and clear of obstructions, and cables, for convenient use of the table and its associated monitor.

The table arrangement and the monitor integrally mounted thereon, as aforesaid, provides improved access between the monitor and a user laptop computer positioned on the table. The monitor support provides a control panel disposed adjacent a lower edge of the monitor and readily accessible from the vicinity of the table top, whereby a user can readily plug a laptop power cord into the control box if necessary or desired. The control panel also has conventional computer connectors or ports associated therewith, such as VGA or HDMI connectors, so that a laptop user can also, through use of conventional connecting cables, join the laptop to the connectors on the control panel, which connectors in turn are joined to the monitor so as to permit control of the monitor by the laptop disposed on the table.

The improved table arrangement, as aforesaid, preferably incorporates a biasing structure, such as uniform-force air springs, coupled between the carriage and the monitor support and disposed to exert a biasing moment or torque which assists in upward swinging of the monitor from its intermediate extended horizontal position into its upright use position, whereby the user hence has to supply only a limited amount of lifting force on the monitor to control the upward swinging thereof into the upright use position, or conversely downward away from the upright position.

In accordance with a variation of the table arrangement of the present invention, which variation integrally mounts the monitor thereon for movement between the upright use and hidden storage positions, but which is designed to accommodate and permit multiple laptop computers to be disposed on the table and connected to the monitor, the table can be provided with a cable control module mounted on the top, generally near the center thereof. This cable module, as is conventional, is supplied with a power cable extending upwardly from the floor through a cable column which, at the module, connects to multiple power receptacles to permit it to accommodate multiple power cords from multiple laptop computers. More significantly, however, this module has multiple computer connectors (or alternately multiple sets of connectors) associated therewith and connected to a switching unit, which switching unit in turn is coupled to connector cables which extend along the wire manager and connect to corresponding connectors or ports associated with the monitor, which connectors may be VGA, HDMI or other conventional digital/analog signal transmission connectors. The cable module hence enables multiple laptop computers positioned on the table top to be connected to the various connectors associated with the cable module which, through manual manipulation and selective switching of the switching unit, enables any of the computers to be in communication with and control the video monitor. In a preferred embodiment of this variation, the signal transmitting connectors associated with the cable module preferably have elongate cables connected thereto and connected between the connector and the switching unit, with the cable lengths being stored in a suitable cable managing device disposed under the table, such as associated with the upright cable column, so that the connectors and attached cables can be manually pulled out of the cable manager for connection directly to the laptop computer, thereby eliminating the need for the user to provide their own separate connecting cables.

Other structural and operational features of the present invention, and the advantages and conveniences provided thereby, will be apparent to persons familiar with constructions of this general type upon reading the following specification and inspecting the accompanying drawings.

Figures 1, 2, 3:
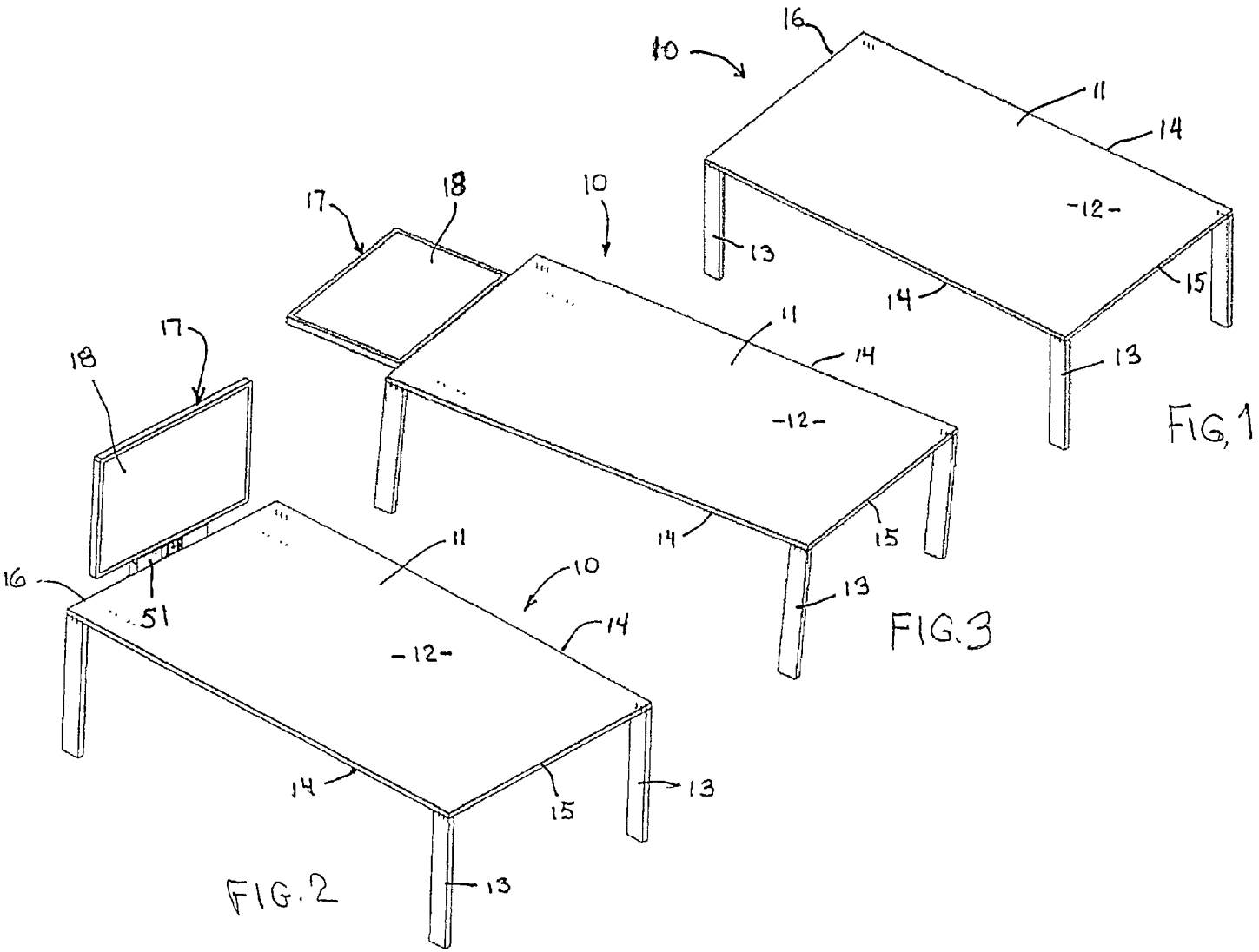
FIG. 1 is a top perspective view of a table arrangement having a monitor arrangement mounted thereon, the monitor being in a stored hidden position below the table top in this illustration.
FIG. 2 is a top perspective view corresponding to FIG. 1, but showing the monitor in its upright use position adjacent one edge of the table top.
FIG. 3 is a top perspective view corresponding to FIGS. 1 and 2, but showing the monitor in an intermediate transitional position between the storage position of FIG. 1 and the use position of FIG. 2.
Figure 6:
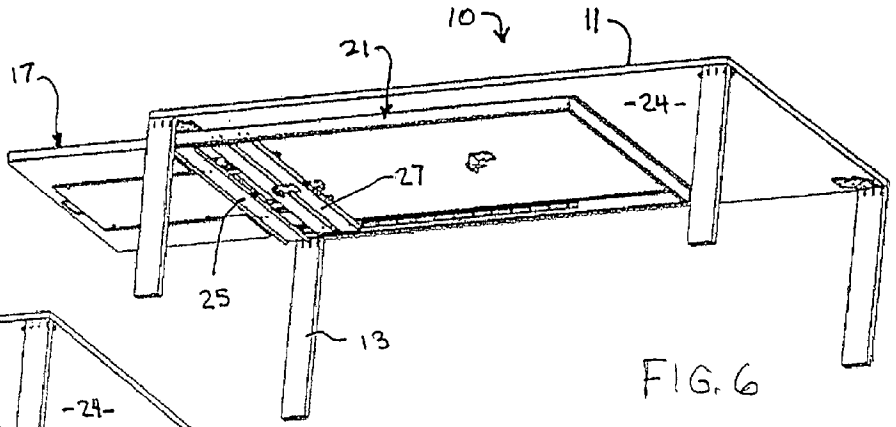
FIGS. 4, 5 and 6 are bottom perspective views which respectively correspond to the positional relationships illustrated in FIGS. 1, 2 and 3, respectively.

Certain terminology will be used in the following description for convenience and reference only, and will not be limiting. For example, the words "upwardly", "downwardly", "rightwardly" and "leftwardly" will refer to directions toward and away from, respectively, the geometric center of the table arrangement and designated parts thereof. Said terminology will include the words specifically mentioned, derivatives thereof, and words of similar import.

DETAILED DESCRIPTION

Referring to the drawings and specifically FIGS. 1-6, there is illustrated a table arrangement 10 which defines a generally conventional horizontally-enlarged table top 11 which defines thereon a horizontally planar top surface 11. The table in the illustrated embodiment has a plurality of vertical legs 13 connected to the underside of the table top and projecting downwardly for engagement with a floor, the legs being disposed adjacent the corners of the table top, such as is conventional, with conference tables. The table top 11 as illustrated has opposed parallel side edges 14 joined by parallel end edges 15 and 16. The table top 11 is typically sized to permit a plurality of individuals, such as typically a minimum of 4 to 8 individuals, to be seated therearound.

In accordance with the present invention, the table arrangement 10 is provided with a flat panel video monitor 17 supported so as to be disposed in a generally vertical or upright positional relationship closely adjacent the end edge 16 of the table top, whereby the front display face 18 of the monitor is oriented toward the region over the table top so as to have significant visibility to all individuals seated around the table.

Figure 4:
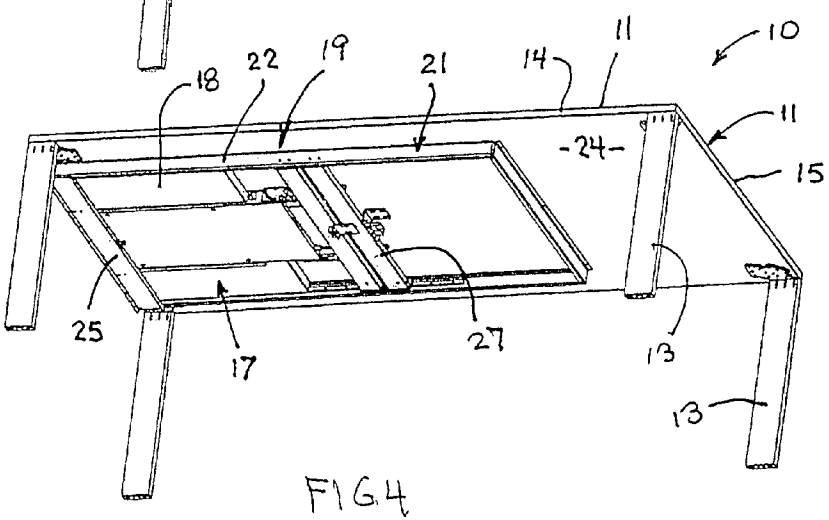
Figure 5:
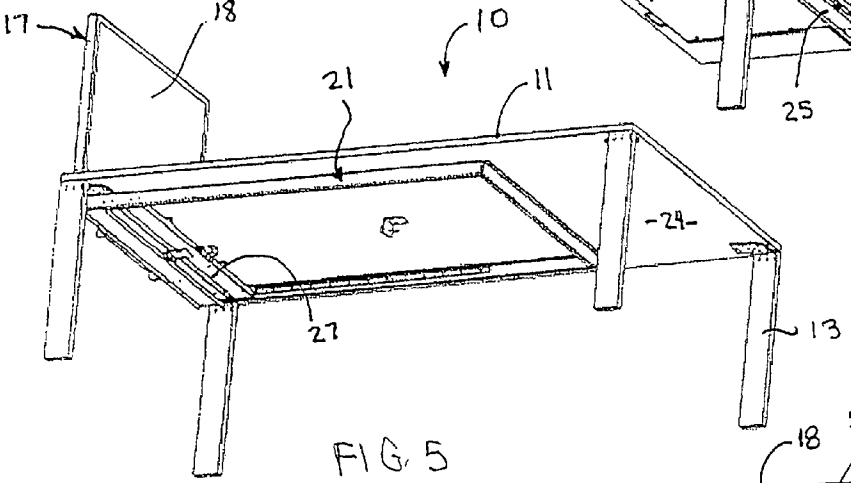

The flat panel video monitor 17 is supported on a support arrangement 19 (FIGS. 3-12) which is disposed substantially entirely beneath the table top 11 and movably supports the monitor 17 so that it can be moved from the upright use position illustrated in FIGS. 2 and 5 into a storage position wherein the monitor is hidden directly below the table top, as illustrated by FIGS. 1 and 4.

Figure 8:
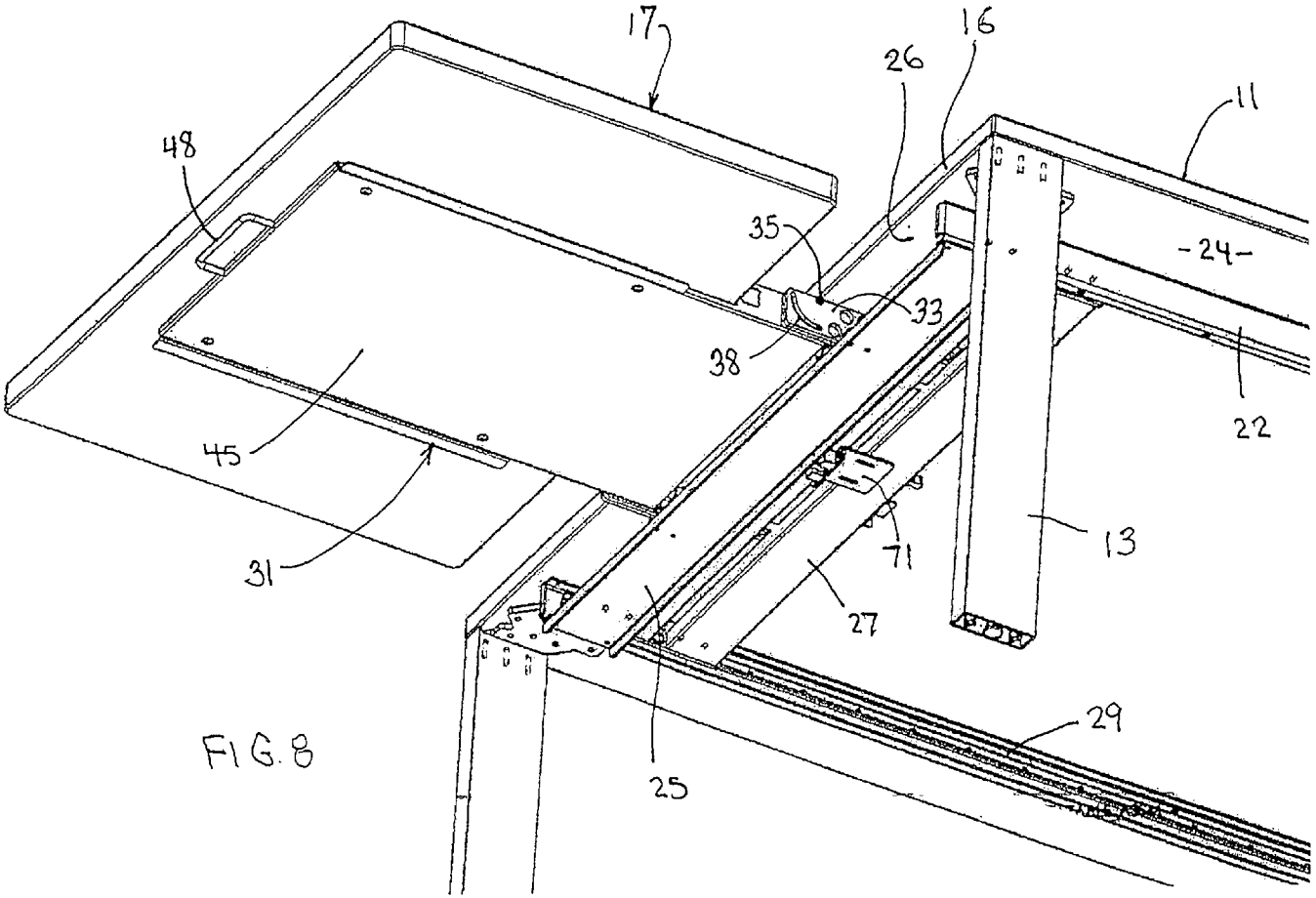
FIG. 8 is a fragmentary enlarged view of a portion of the table as shown in FIG. 6.
Figure 8A:
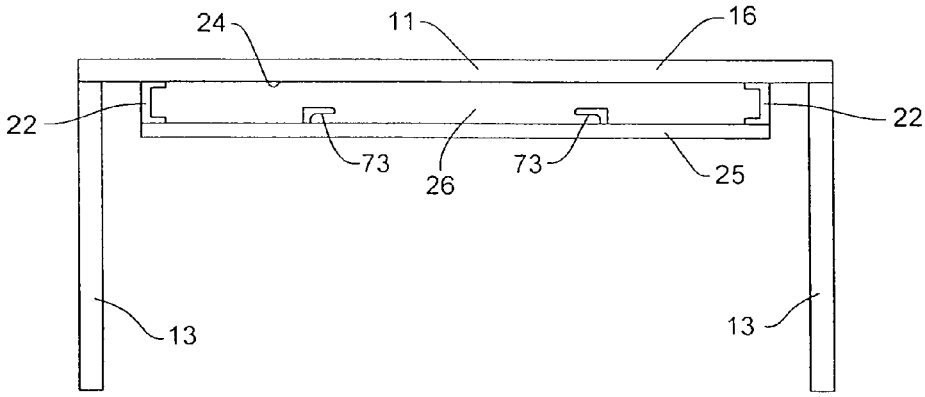
FIG. 8A is an end elevational view of the table with the carriage and monitor assembly removed for clarity of illustration.
Figure 9:
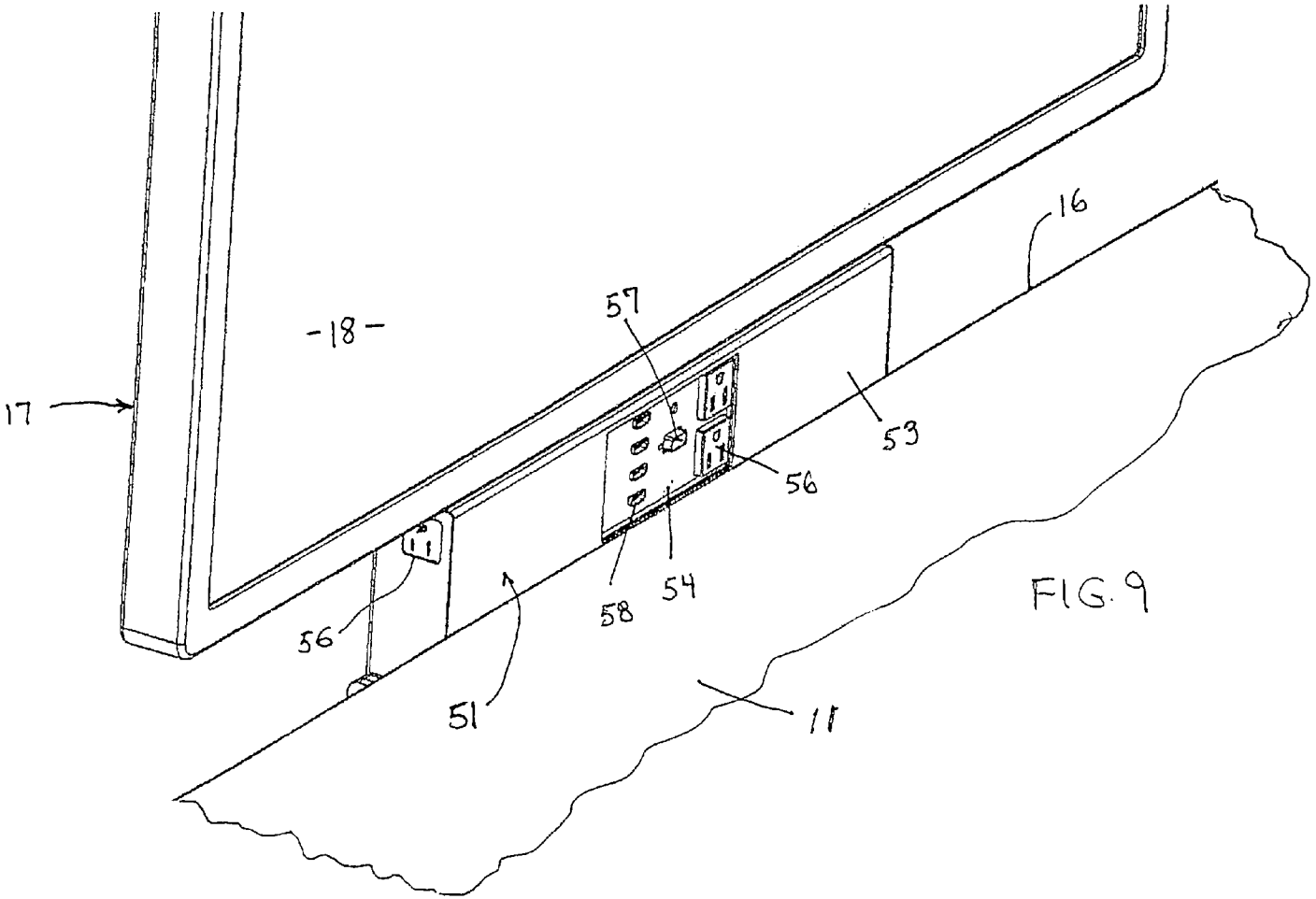
FIG. 9 is a fragmentary enlarged view showing the relationship of the monitor, in its upright use position, relative to the table top.

The support arrangement 19 for the monitor includes a generally ring-shaped rigid support frame 21 which is generally horizontally oriented and is fixedly secured to the undersurface 24 of the table top 11. Support frame 21 includes elongate side frame elements 22 which extend in sidewardly-spaced but parallel relationship, and which at one end are joined together by a transverse end frame element 23 extending therebetween. The side frames 22 and the end frame 23 are all rigidly fixed directly to the underside of the table top, with the end frame 23 being disposed remote from the monitor-positioning table edge 16, and the side frames 22 projecting horizontally toward the end edge 16 in generally perpendicular relationship thereto. The side frames 22, at the ends thereof adjacent the table edge 16, are rigidly joined by a transverse end frame element 25 which, as illustrated in FIGS. 8 and 8A, is spaced vertically downwardly a small distance below the table top 11 so as to define a horizontally elongate clearance space or slot 26 which extends sidewardly between the side rails 22 and which provides adequate clearance to enable the monitor to be moved horizontally through the slot from the position of FIGS. 6 and 8 into the storage position of FIG. 4. The horizontal sideward width of this slot 26 is determined basically by the sideward spacing between the rails 22, which rails are disposed within the sideward spacing between the pair of adjacent legs 13 under the table edge 16. This slot width defines the maximum width of monitor 17 which can be utilized and moved into the under-table storage position.

Figure 12:
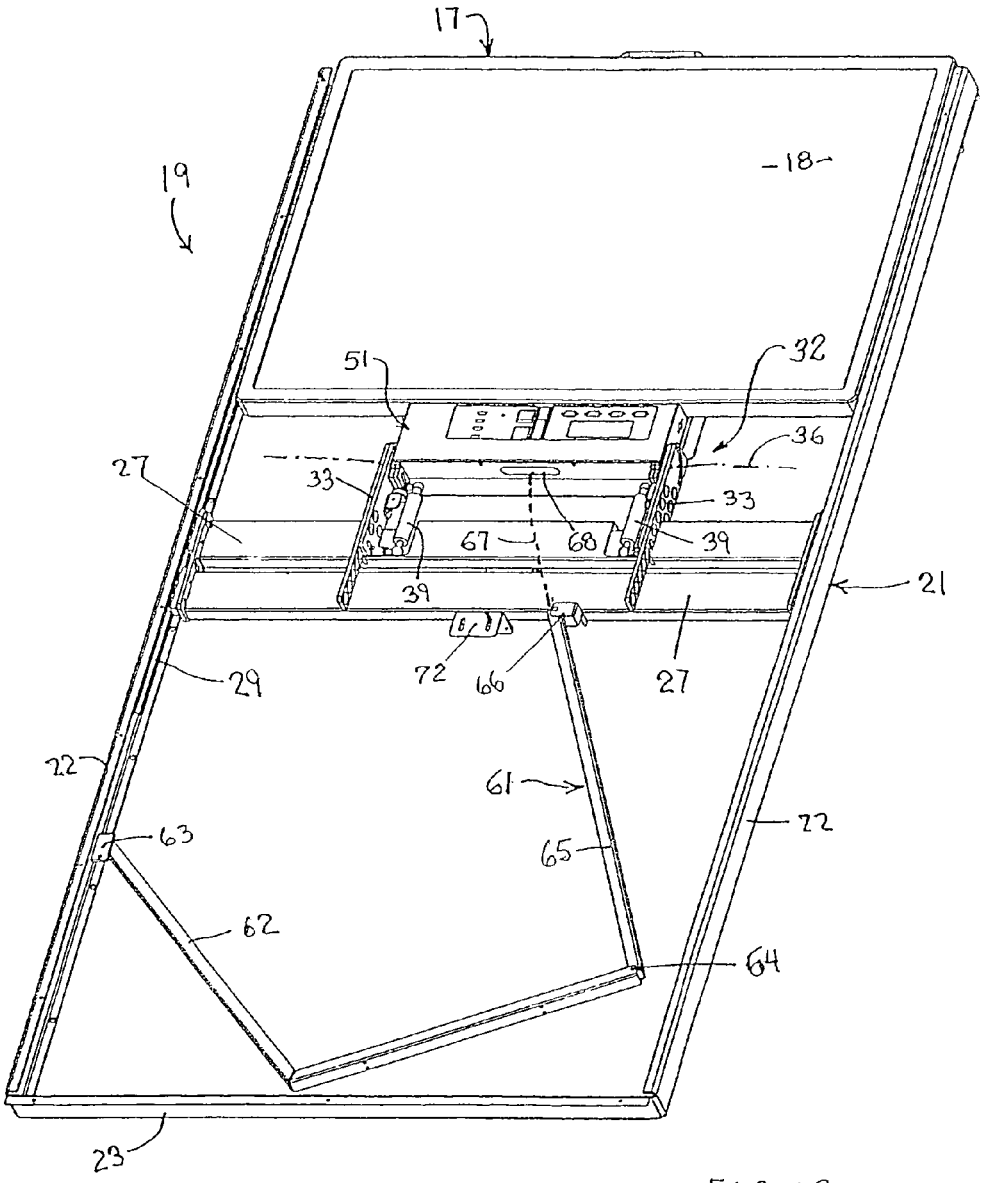
FIG. 12 is a top perspective view of the support arrangement for the monitor, such arrangement being illustrated as viewed directly below the table top.
Figure 13:
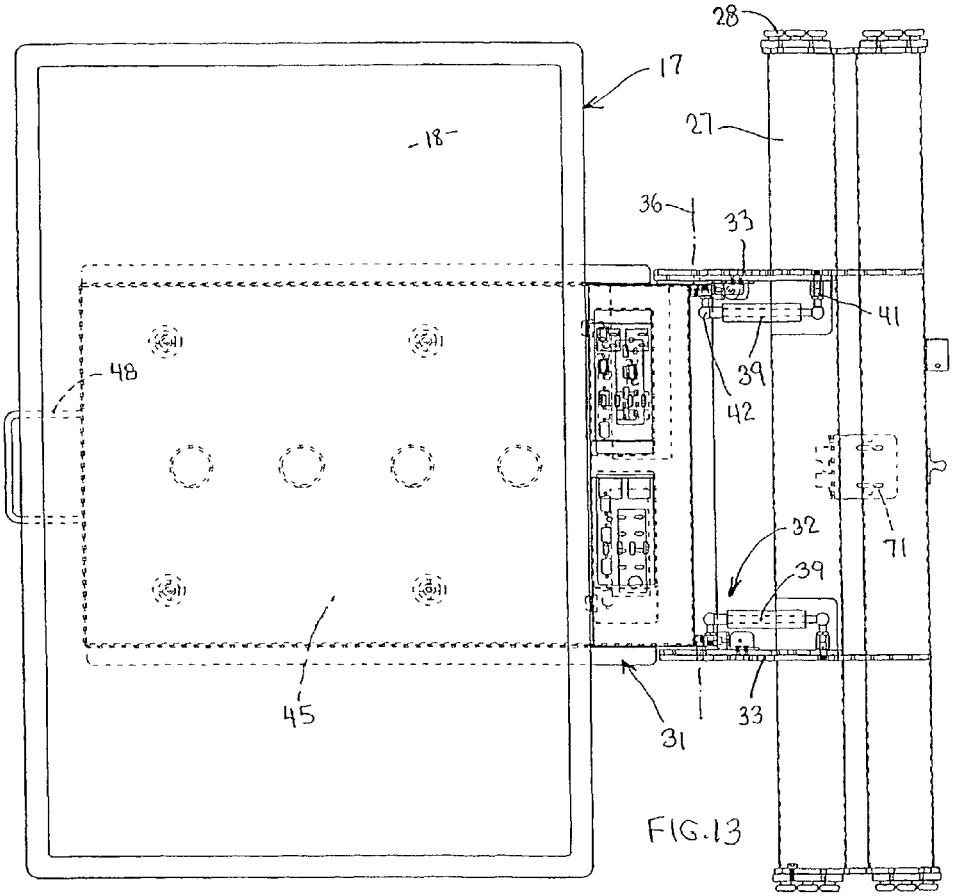
FIG. 13 is a top plan view of solely the monitor and its attachment to the monitor support frame, as pivotally joined to the slidable carriage, the overall assembly being shown in its horizontal condition, such as when stored beneath the table.
Figure 14:
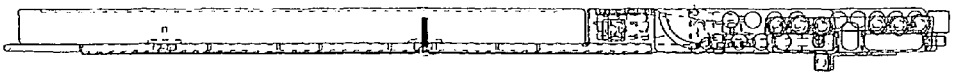
FIG. 14 is a side edge view of the arrangement shown in FIG. 13.
Figure 15:
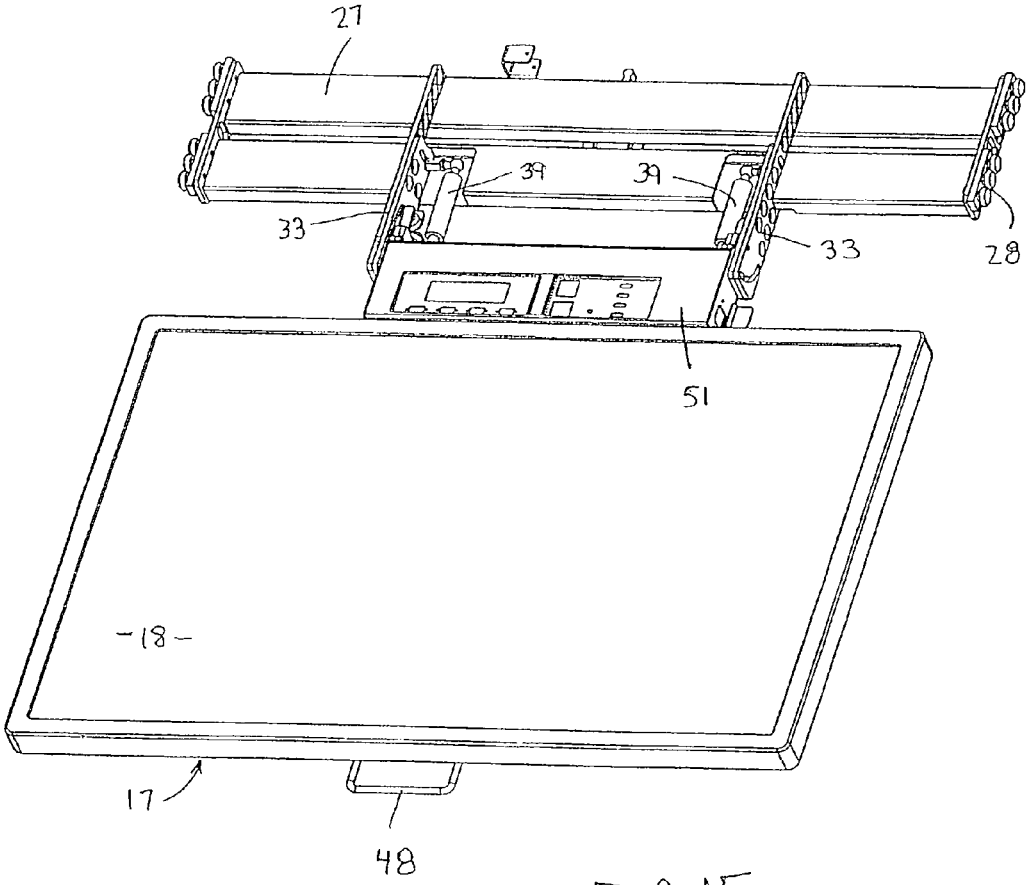
FIG. 15 is a view similar to FIG. 13 but showing the carriage and monitor assembly in a perspective view.

To permit movement of the monitor 17 between the horizontal storage position and the upright use position as described above, the support arrangement 19 includes a carriage 27 which is disposed directly under the table top and extends transversely thereacross for engagement with opposed parallel guide rails 29 which are fixed to and extend lengthwise along respective frame side rails 22. The ends of the carriage 27 are provided with rollers 28 which are rollingly engaged with the parallel guide rails 29 to enable the carriage to move between a use position wherein the carriage is disposed closely adjacent the table edge 16, as illustrated by FIGS. 5-8, and a retracted storage position wherein the carriage is moved inwardly under the table top so as to be disposed more closely adjacent the rear frame cross rail 23, as illustrated by FIGS. 4 and 12.

The carriage 27 hence is movable horizontally directly below the table top from the retracted storage position to the extended use position, and each of these positions are preferably limited and defined by suitable stops which hence control the carriage movement. For example, a first catch 72 is mounted to the underside of the table and positioned for engagement with the carriage 27 when the latter is in its retracted position as illustrated in FIG. 12. Similarly, the carriage 27 itself mounts a catch 71 thereon, the latter being engageable with an opposed catch part mounted on the cross frame rail 27 to define the front or extended position of the carriage.

In addition to the carriage 27, the support arrangement 19 includes a monitor support frame 31 which is coupled to the carriage 27 and which is adapted to directly mount the flat panel monitor 17 thereon. The support frame 31 at its lower or rearward edge is coupled to the carriage 27 by a hinged connecting structure 32 which, as hereinafter described, defines a generally horizontal hinge axis 36 which extends perpendicularly between the side rails 22, and parallel to the table edge 16, so as to enable the support frame 31 and the monitor 17 mounted thereon to be vertically pivotally moved upwardly from the horizontal orientation illustrated by the transitory position of FIGS. 3 and 6 into the upright use position illustrated by FIGS. 2 and 5.

More specifically, to define the hinged connecting structure 32, the carriage 27 mounts thereon a pair of generally parallel arms 33 which are sidewardly spaced and protrude horizontally toward the adjacent end of the support frame 31 in generally perpendicular relationship to the hinge axis 36. These sidewardly-spaced arms 33 are disposed closely adjacent and sidewardly overlap a pair of parallel but sidewardly spaced brackets 34 which are fixed to and protrude outwardly from the adjacent end of the support frame 31. The overlapping parallel arms 33 and support brackets 34 are joined by a primary hinge pin 35 which extends through aligned openings 35A formed in the adjacent arms 33 and brackets 34 as diagrammatically illustrated in FIG. 16. Hinge pin 35 defines the primary pivotal axis 36 for the monitor support frame 31. The brackets 34 in addition mount thereon a sidewardly protruding guide pin 37 which is parallel with and spaced radially from the main pivot pin 35, which guide pin 37 protrudes into an arcuate guide slot 38 as formed in the adjacent arm 33. The guide slot 33 is of an arcuate configuration which extends through approximately 90°, or slightly in excess thereof, so as to enable the guide pin 37 to move through a full 90° angle, and this slot 38 is generated on a uniform radius about the primary hinge axis 36. The positioning of the arcuate slot 38 is such that when the guide pin 37 is in the lower end of the slot 38, the support frame 31 projects generally horizontally in the plane of the carriage, whereas movement of the guide pin 37 into the upper end of the slot 38 results in the monitor support frame 31 being generally upwardly vertically oriented.

Figure 7:
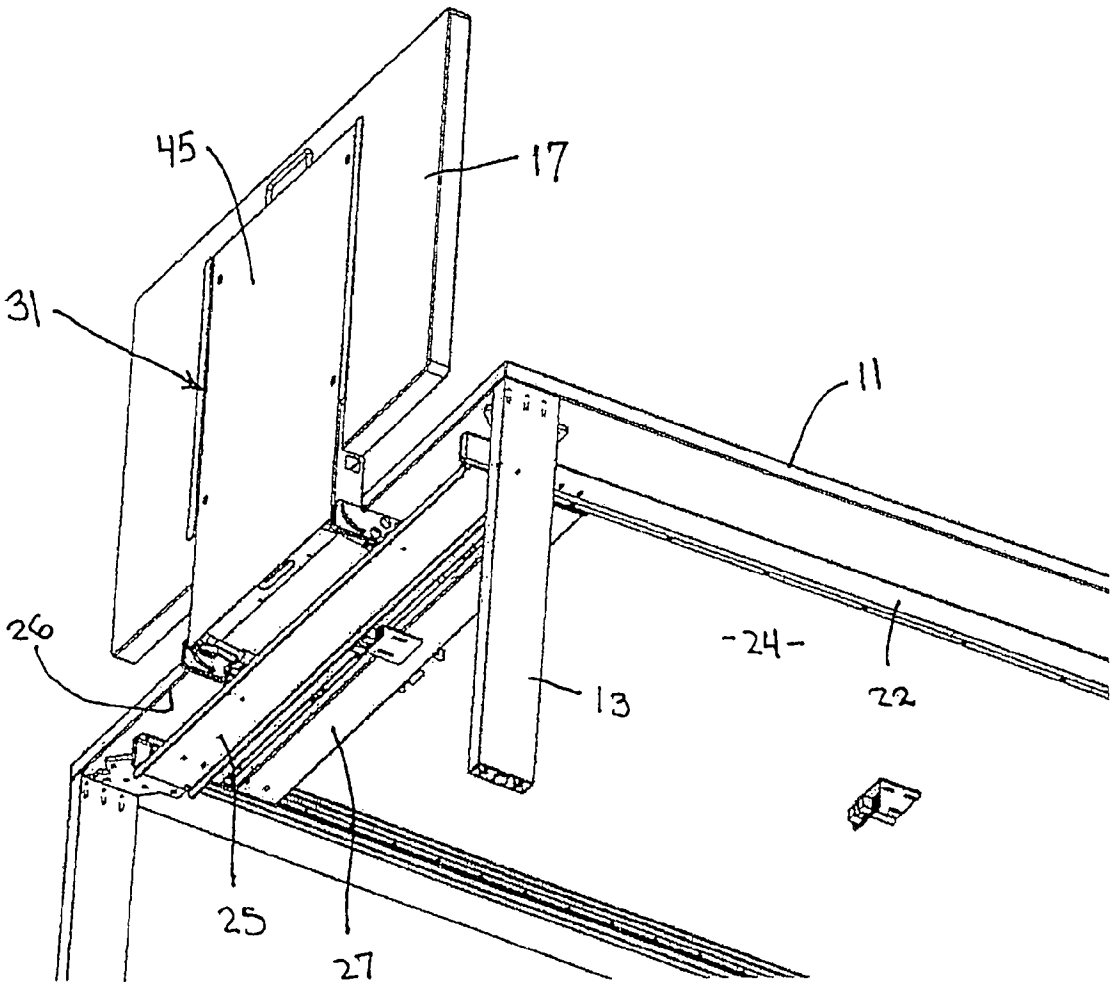
FIG. 7 is a fragmentary enlarged view of a portion of the table as shown in FIG. 5.

To provide assistance and improved control over the movement of the monitor 17 as it is swung vertically either upwardly or downwardly between the positions illustrated by FIGS. 7 and 8, there is preferably provided a pair of springs 39 which couple between the carriage 27 and the support frame 31 to provide a biasing force which assists in urging the monitor to swing upwardly from a horizontal orientation into a vertical orientation about the hinge axis 36. The biasing moment created by these springs 39 may be less than the opposite moment created by the weight of the monitor and its supporting frame, and hence during actual vertical swinging of the monitor the springs function as an assist in that they minimize the amount of manual vertical force required by an operator to effect upward vertical swinging movement of the monitor. However, if desired, the springs 39 and the upward biasing moment may be sized to effect upward swinging of the monitor and frame without requiring any manual assisting force.

The springs 39, which in the illustrated embodiment are pneumatic springs which are preferably of the type known as uniform force springs, each has one end 41 thereof hingedly connected to a respective arm 33 on the carriage 27, where the opposite end 42 is hingedly connected to the respective bracket 34 of the support frame 31.

Figure 16:
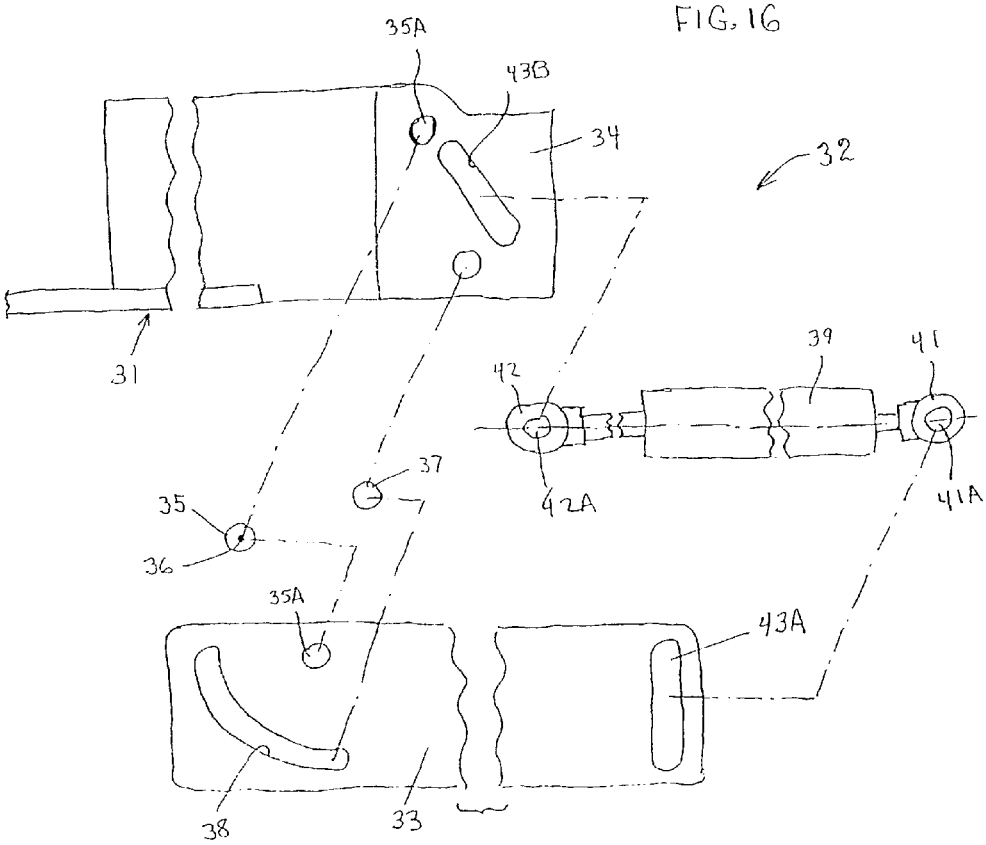
FIG. 16 is an enlarged exploded view showing the hinged connection between the monitor support frame and the carriage.
Figure 16A:
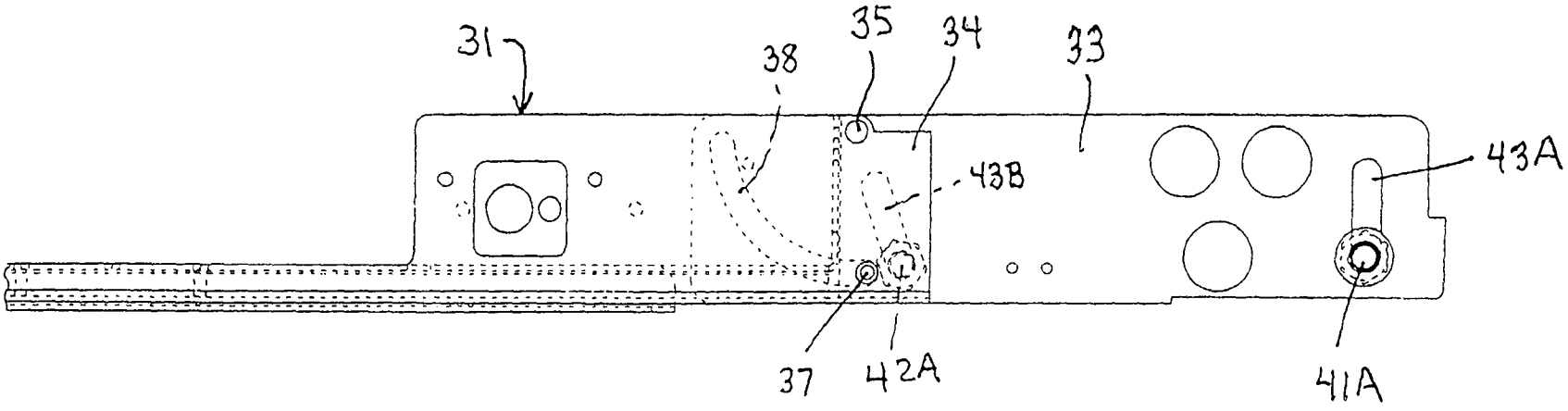
FIGS. 16A and 16B illustrate the hinged driving connection between the carriage and the monitor support frame and respectively illustrate the support frame in horizontal and vertical positions.
Figure 16B:
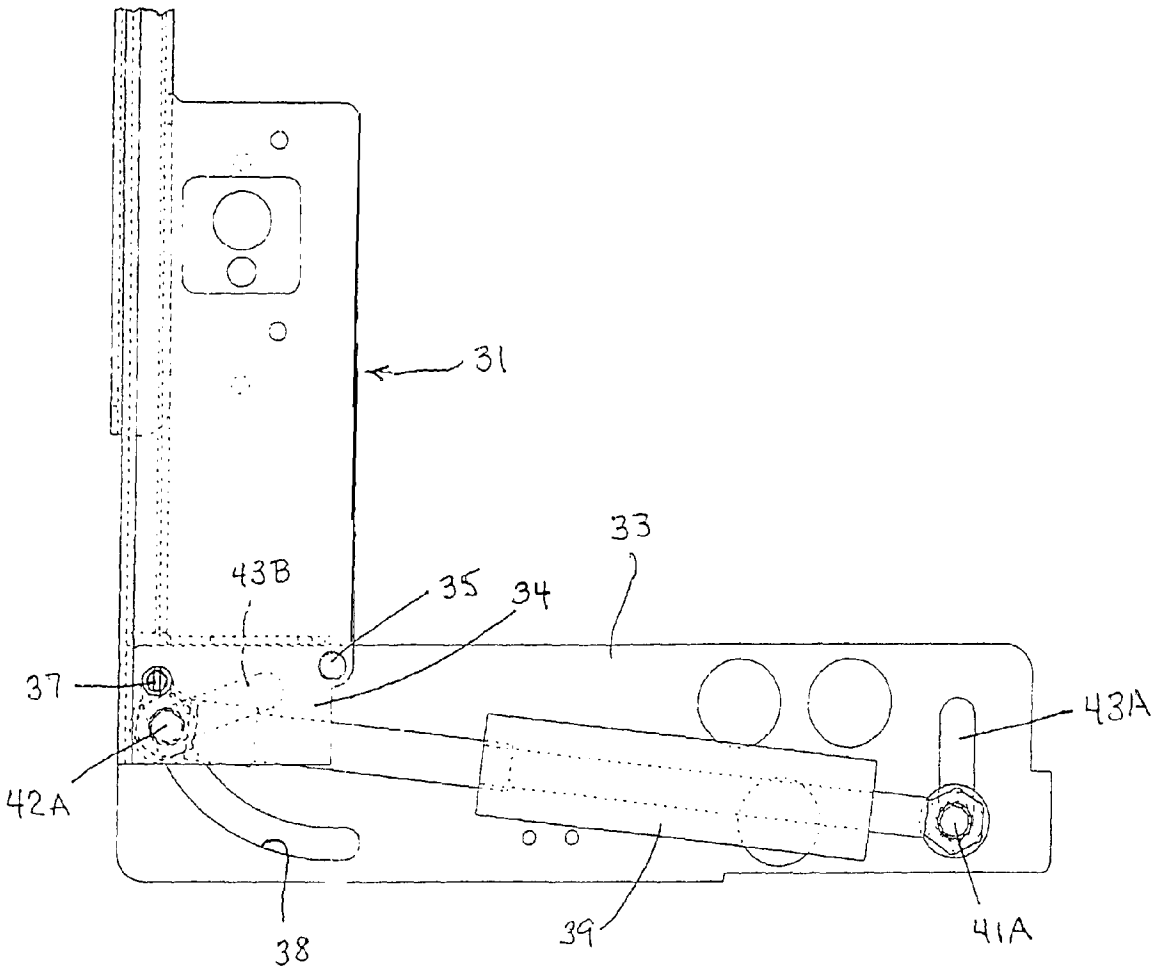

More specifically, as illustrated in FIG. 16, the rear end 41 of the spring has a drive pin 41A which protrudes into a slot 43A formed in the rearward end of arm 33. The slot 43A is elongate generally vertically, and during assembly the pin 41A is positioned at a selected location lengthwise along the slot 43A, and is then locked in position by a lock nut threaded thereon for holding engagement with the bracket.

Similarly, the front or outer end 42 of the spring has a drive pin 42A which protrudes into an elongate slot 43B formed in the adjacent bracket 34. The pin 42A, when in a selected position along the slot, is locked in this position by means of a lock nut threaded thereon. The slot 43B is elongated in a direction which extends substantially radially away from the hinge pin 35.

The presence of the slots 43A-43B, and the selective positioning of the pins 41A-42A therein, allows the desired biasing force, and specifically the biasing torque, when the monitor is in the horizontal and vertical positions, to be adjusted somewhat independently to achieve the desired feel and operation, and accommodate different weight monitors. Further, due to the orientation of the slot 43B, the position of pin 42A in slot 43B has only minimal impact on the biasing force and torque when the monitor and frame are in the vertical orientation. Thus, the horizontal-position biasing force can be adjusted without significantly changing the vertical-position biasing force.

In addition, the disposition is such that, when the monitor is in its upright position as illustrated by FIGS. 2 and 7, the springs 39 exert a sufficient force moment (counter-clockwise about the hinge axis 36) to continually urge the monitor into its vertical upright orientation, the latter being determined by appropriate stops which cooperate between the monitor support frame and the carriage arms.

Figure 17:
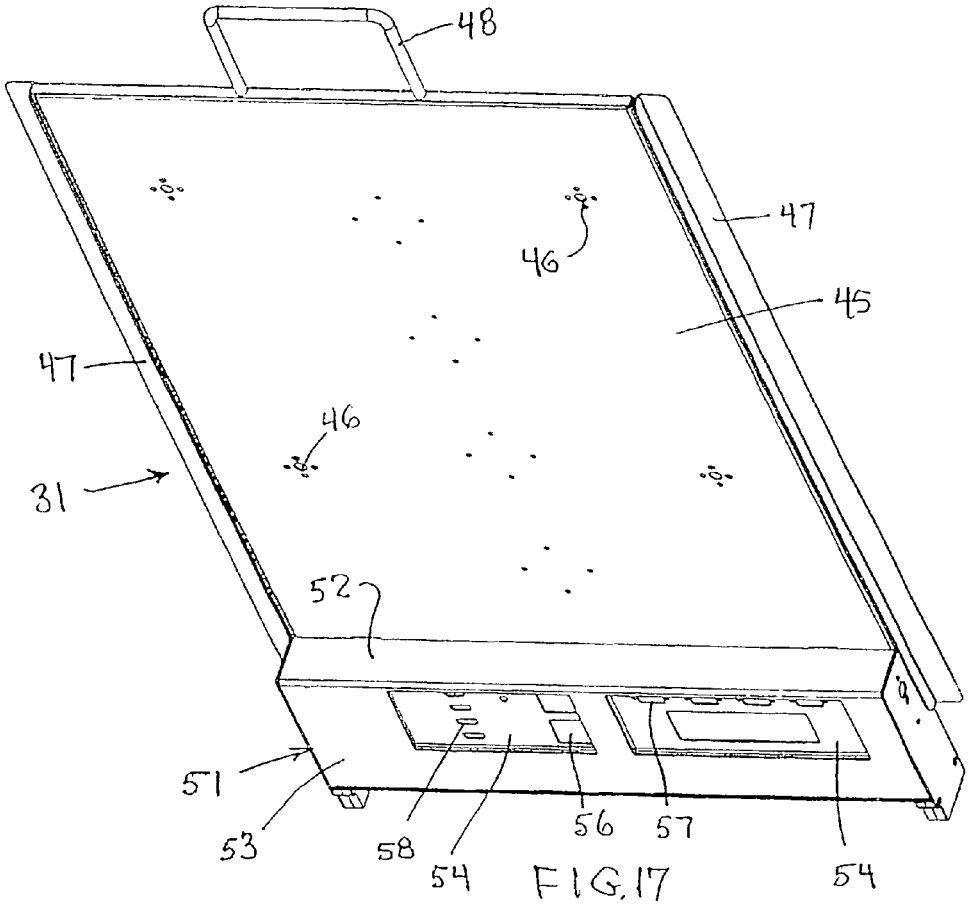
FIG. 17 is a perspective view of the monitor support frame, with the monitor removed for clarity of illustration.
Figure 18:
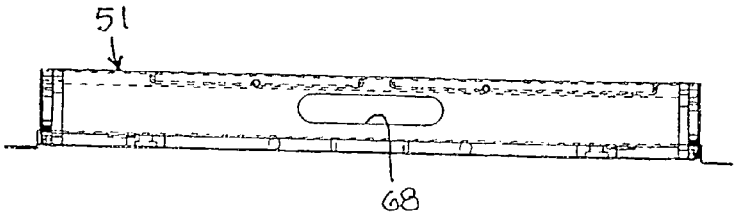
FIG. 18 is a bottom or lower end view of the monitor support frame of FIG. 17.

With respect to the monitor support frame 31, and referring to FIGS. 17-18, it is defined by a main support member 45, such as an enlarged plate, the latter being adapted to be positioned so as to generally overlie a significant portion of the back side of the monitor 17, as illustrated by FIGS. 7 and 8. The plate 45 has a plurality of holes or connecting locations 46 which accommodate suitable fasteners which are compatible with the fastening locations provided on the back of the monitor to permit fixed securement of the monitor to the support plate 45. The support plate 45, as illustrated, has edge rails 47 fixed to and extending along the opposite vertical edges thereof so as to provide additional reinforcement, and to also assist and function as guides for facilitating the inward sliding movement of the monitor from the intermediate horizontal position of FIG. 8 into the horizontal storage position of FIG. 4. These rails 45 pass under the guides 73 FIG. 8A) when the monitor is moved between the storage position (FIG. 4) and the extended intermediate position (FIG. 6) so as to maintain the monitor in a proper horizontal orientation.

The monitor support frame 31 is also preferably provided with a handle 48, such as a U-shaped arrangement, fixed to the outer or upper edge thereof, the latter preferably being disposed in close proximity to the upper edge of the monitor 17 when the latter is mounted on the support 45. This handle, which is spaced rearwardly a small distance from the monitor, enables manual gripping so that a user can readily grip the handle so as to not only move the monitor and its support frame horizontally between the intermediate and storage positions of FIGS. 6 and 4, but also vertically swing the monitor between the intermediate and upright positions of FIGS. 6 and 5 respectively.

The monitor support frame 31 is also preferably provided with a control structure, herein referred to as a control box 51, fixed to the support frame and extending horizontally along a lower or inner edge thereof. The lower edge of the flat panel monitor 17 is seated close to and generally directly above the top wall 52 of the control box. The control box 51 projects downwardly, and the mounting brackets 34 project downwardly from lower corners thereof.

The control box 51 has a front wall 53 which is generally parallel with the main plate 45, and is vertically oriented when the monitor is in its upright position. This wall 53 mounts thereon one or more panels 54, two in the illustrated embodiment, which mount a plurality of electronic ports or connectors of different types, including at least one or more conventional electrical receptacles 56, and two or more different types of conventional connectors as used for connection to digital/analog signal-transmitting cables, such as a VGA port or connector 57 and an HDMI port or connector 58. Connectors for supplying audio and video signals to the monitor will typically be provided.

To supply electrical power to the control box 51 and hence to the flat panel monitor 17, the monitor support arrangement 19 is preferably provided with a cable manager 61 (FIGS. 10 and 12) is defined, in the illustrated arrangement, by a horizontally movable linkage positioned closely adjacent the underside of the table top 11 and movable in response to the movement of carriage 27. At the same time the cable manager 65 allows an electrical power cable to extend therethrough for supply to the control box 51.

The cable manager 61 as illustrated includes a first elongate link 62 which at one end is hinged at 63 to one of the fixed side rails 22. This link 62 at its other end is hingedly connected at 64 to a further elongate link 65 which, at its opposite end, is hinged at 66 to the carriage 27. The cable manager links 62 and 65 are preferably hollow channel-shaped elements which enable a power cable to be fed internally therealong, and captivated therein. The power cable which extends outwardly at the hinge 66 extends through the carriage 27 (the power cable being indicated by dotted line 67) and then through a slot or opening 68 formed in the bottom of the control box 51, wherein the power cable can be connected to the front receptacles 56 and also to a further receptacle mounted on the side or back of the power box, which latter receptacle in turn receives a plug associated with the power cable provided on the monitor 17.

The cable 67 which passes through the cable manager 61, at the hinge 63, extends along the rail 22 or along the underside of the table top 11 to an adjacent leg 13, at which point the power cable is secured to the leg and passes vertically downwardly therealong, preferably within a guide slot formed in the leg (which slot is closed by a removable cover). The cable 67 at the lower end of the leg then traverses the floor to the nearest floor-mounted power receptacle. Power can thus be supplied to the monitor, which can be safely moved between storage and use positions, while at the same time the area under the table is wholly free of drooping or dangling cables.

With respect to the remaining ports or connectors 57 and 58, they are preferably connected internally within the box 51 to additional similar connectors which are also mounted on the ends or back of the control box, which latter connectors in turn are connected to cables which connect to appropriate similar connectors provided on the back side of the video monitor 17, such as is conventional with flat panel video monitors of the type discussed herein. Alternately, the ports 57 and 58 can be connected to cables which extend through the control box and outwardly therefrom for direct connection to similar connectors or ports associated with the video monitor. The provision of the connectors 57 and 58 mounted on the front panels of the control box, when the latter is in the use position disposed adjacent and just above the table edge 16, permits a user to position a laptop computer or other electronic device on the table top 11 and then connect the computer or device to the connectors 57 and 58 so as to permit control of the video monitor from the adjacent computer or device. Similarly, the power cord for the computer or device can be plugged into one of the receptacles 56 if desired.

To provide increased flexibility and accessibility over control of the monitor 17 when the latter is in its upright use position, the table arrangement of the present invention can be modified to provide it with a cable module 76 (FIG. 19) which mounts to the table top, generally substantially at the center thereof, so as to be readily accessible by multiple users seated around the table. The cable module 76 requires formation of an opening through the table top below the cable module to facilitate access of cables into the module from below.

Figure 19:
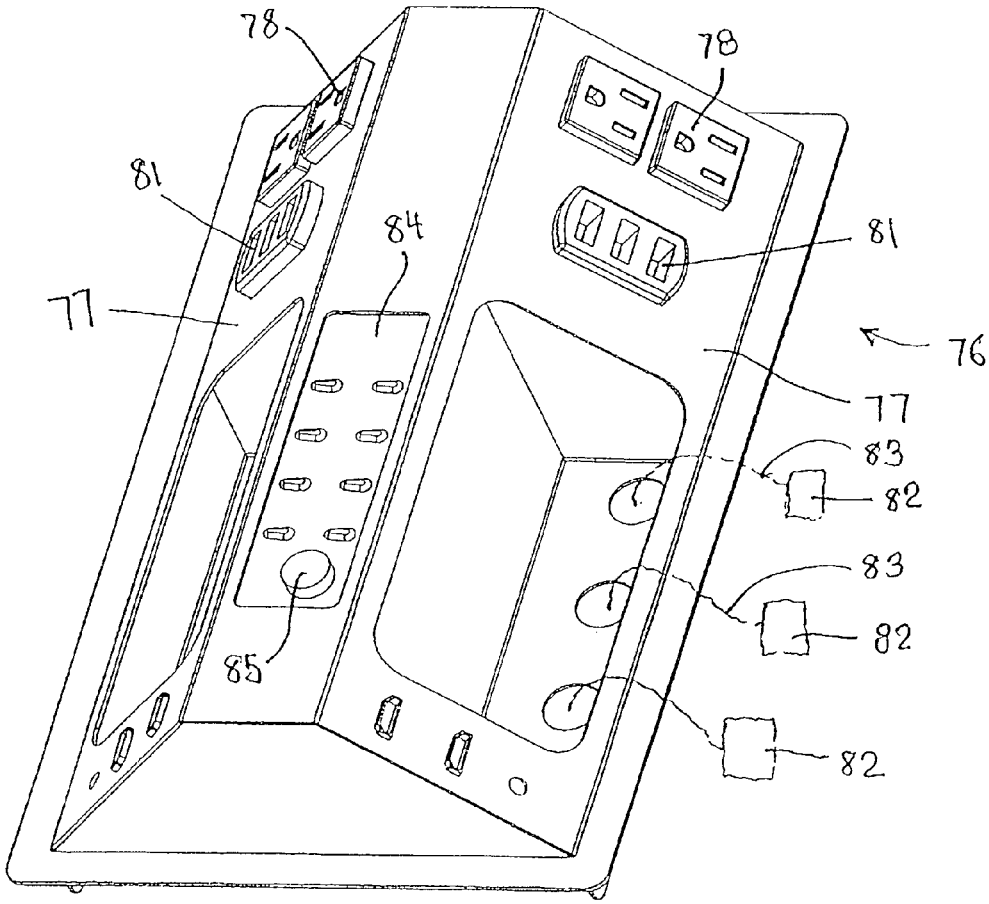
FIG. 19 is a perspective view of a cable control module which can be attached to the upper surface of a table in accordance with a modification of the present invention.

The cable module 76 illustrated by FIG. 19 preferably includes a pair of side panels 77 disposed on opposite sides to facilitate access from opposite sides of the table top, and each side panel mounts a plurality of different cable connectors to facilitate connection to multiple computers or devices positioned on the table top. For example, each panel of the cable module preferably has a plurality of conventional power receptacles 76 mounted thereon, which receptacles are connected to the main power supply cable which extends to the table, which main power supply cable also extends along the underside of the cable through the cable manager to the monitor in the manner as described above.

Each side panel 77 of the cable module also mounts a plurality of other conventional connectors or parts thereon, such as connectors 81 which can be fixedly mounted on the side panel so as to accept engagement with an external cable extending from a laptop computer or electronic device. Other connectors 82 can also be provided, the latter in the illustrated arrangement being coupled to the ends of elongate cables 83 which extend through the cable module for storage in a suitable cable retractor coil or management device located below the table top, whereby the connectors 82 and the associated cables 83 can be manually pulled outwardly from the cable module 76 to permit direct plug-in connection to a computer or device disposed on the table top. The connectors 81 and 82 preferably define a plurality of different types of connectors suitable for transmission of digital and/or analog signals, including connectors such as HDMI, VGA, and others as deemed suitable or desirable.

All of the signal-transmitting connectors associated with the cable module 76 are connected to a conventional switching unit 84 which is mounted as an integral part of the cable module 76. Switching unit 84 accommodates multiple inputs and, acting through a manually-controlled switch 85, allow a selected one of the inputs to connect to an output. The output from the switching box 84, in the form of signal transmitting cables, extends from the switching box along the wire manager 61 to the carriage and thence into the control box 51 associated with the monitor 17 to provide control over the monitor. Multiple switchable inputs can thus be provided for controlling the monitor.

The types of signal connectors or ports, including audio and video ports, as well as the switching box 84, are all conventional and well known, whereby further detailed description thereof is believed unnecessary.

With the improved table arrangement of the present invention, the monitor support arrangement is particularly desirable for use with newer styles of flat panel video monitors, particularly LED monitors, and the arrangement will, in accordance with the size of the table top and specifically the width thereof, typically accommodate 32 inch wide and 40 inch wide monitors so as to provide significant access and visibility to the individuals seated around the table, while at the same time enabling the monitor to be fully stored and hidden below the table top without interfering with conventional use of the table by individuals seated therearound when use of the monitor is not desired. The overall arrangement of this invention is particularly desirable for use on large tables, including wider tables which may be on the order of 60 inches wide, since this size table permits use of a large flat panel video monitor, and at the same time readily accommodates several individuals along each side of the table, and the width of the table readily accommodates the positioning of multiple laptop computers on the table top adjacent both sides thereof.

The monitor support arrangement of this invention, and specifically a monitor support arrangement similar to that illustrated by FIG. 12, is particularly desirable since it can be attached to a table at the factory if desired, but more significantly, the arrangement 19 of FIG. 12 can be constructed as a kit and readily retrofitted to the underside of any conventional existing table having the requisite size to accommodate the frame 21 of the assembly and having a suitable undersurface on the table top so as to permit mounting of the assembly 19 thereto. As briefly described above, the entire monitor support assembly 19 is supported by the frame 21, which latter frame secures to the undersurface of the table top by means of fasteners such as screws which extend through the side rails 22 and the end rail 23 (if necessary) to permit fixed securement of the assembly 19 to the table top. Further, the monitor mounting arrangement of the invention does not require modifying or reconstruction of the table top.

It will be appreciated that, if desired, the monitor support arrangement 19 can be formed as an integral part of a table during original manufacture thereof, such as in instances where the table is provided with side flanges or skirts which are integrated to the table top, such by molding or the like, and in such case the remainder of the monitor support mechanism can be mounted directly to skirts or edge rails which are integrated to the table top.

With the monitor support arrangement of the present invention, as mounted on and positioned adjacent the underside of the table, and with the monitor secured to the monitor support, the overall structure of the monitor support arrangement and the monitor assembled thereon provides for a very compact arrangement in terms of vertical height inasmuch as the entire arrangement when in the storage position is disposed closely adjacent and directly under the underside of the table top, and the entire arrangement protrudes downwardly from the underside of the table top through only a small vertical extent, such as in the neighborhood of about 3 inches. In addition, all of the structure associated with the carriage and the monitor support frame, as well as the monitor mounted on the support frame, are positioned sidewardly between the parallel side rails 22, and in addition are disposed generally within the space or envelope defined by the side rails, that is, there is no significant downward protrusions which would interfere with effective use of the space below the table by users seated around the table. The resulting table, even with the monitor supporting arrangement mounted thereon, retains a conventional clearance height under the table consistent with tables which are typically and conventionally provided with a side skirt extending around the periphery of the top.

Figure 20:
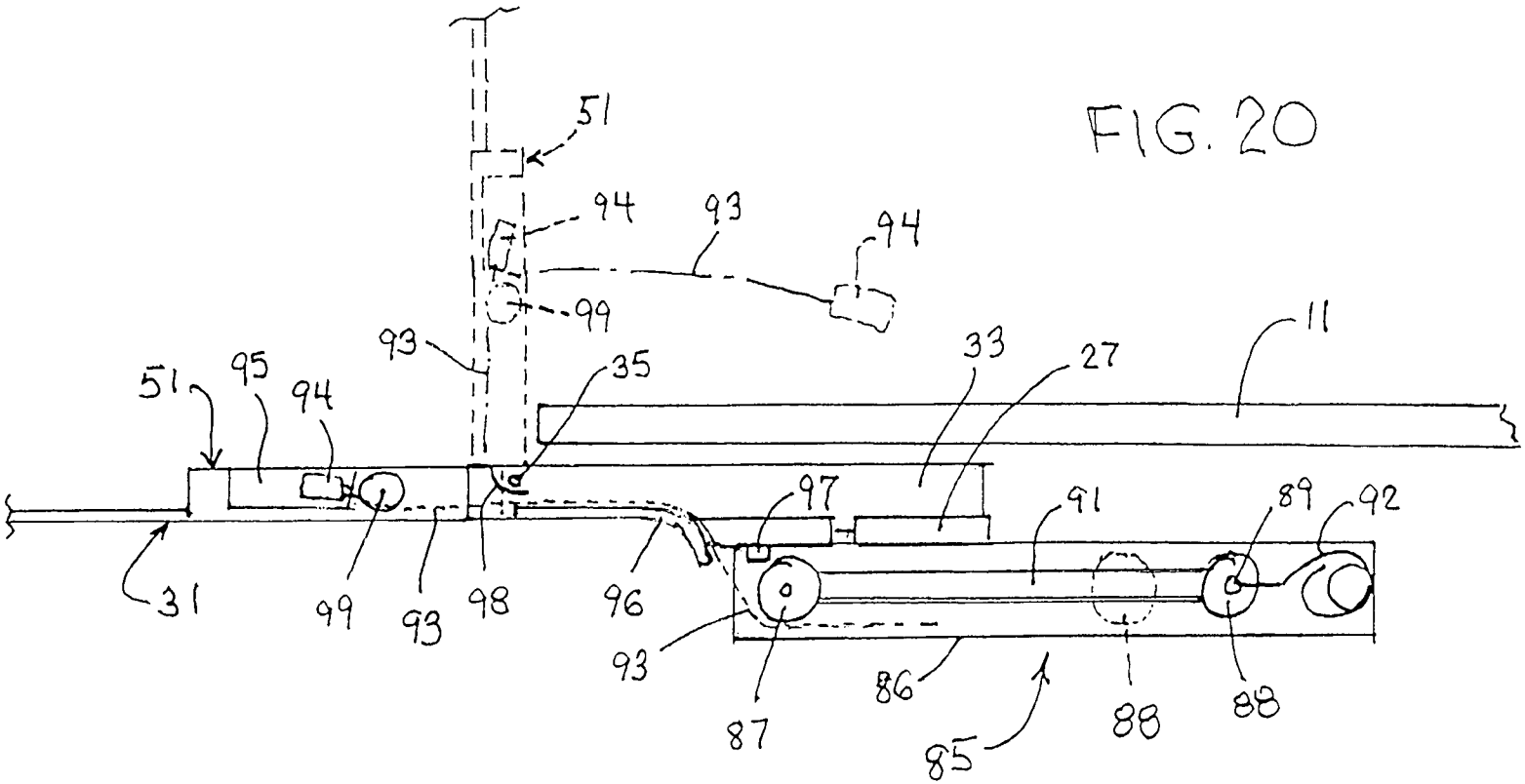
FIG. 20 illustrates a further variation of the invention.

Referring to FIG. 20, there is illustrated a variation of the table arrangement of FIGS. 1-18. In this variation, the monitor ports or connectors 94 associated with the control box 51 are movably positioned in an open recess or compartment 95 formed in the front of the control box. These connectors 94 are provided on the ends of signal transmitting cables 93 which extend from box 51 into a cable retractor (i.e., a cable manager) 85 which is mounted on the carriage 27.

Figure 10:
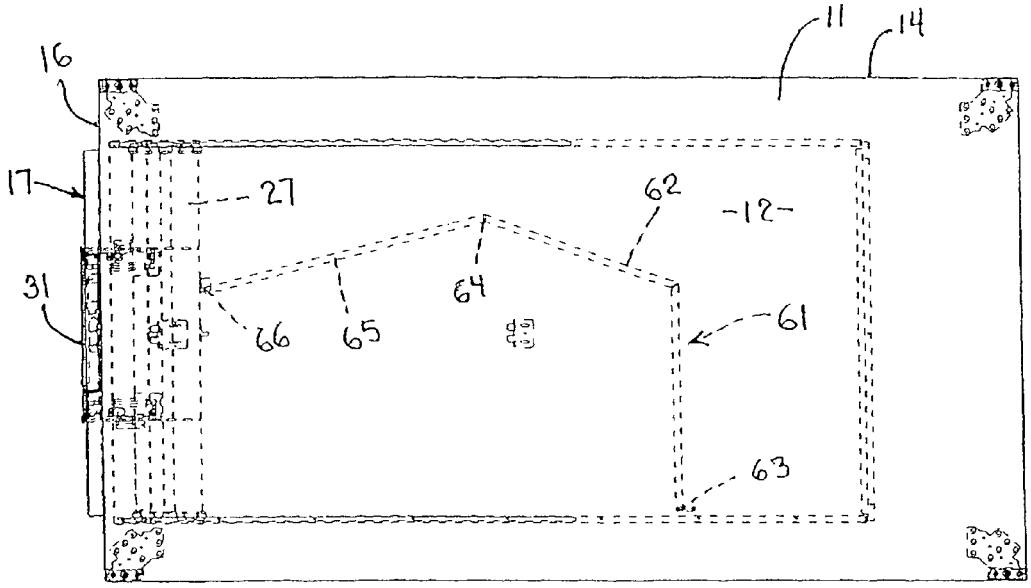
FIG. 10 is a top view of the table arrangement when the monitor is in the upright use position of FIG. 6, with the monitor support arrangement located under the table being illustrated in dotted lines.
Figure 11:
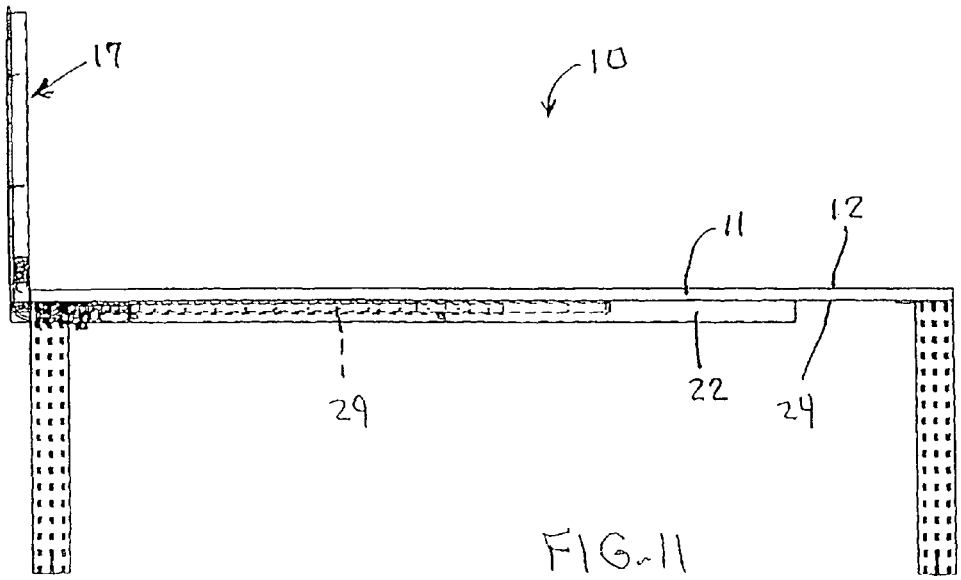
FIG. 11 is a side elevational view of the table arrangement shown in FIG. 10.

The cable manager 85 is mounted generally to the underside of the carriage, and is horizontally elongated so as to extend away from the monitor support frame generally along the lengthwise centerline of the table top. The cable manager, however, is spaced a small distance downwardly from the table top so as to not interfere with the cable manager 61 (FIG. 10).

The cable manager 85 includes a boxlike housing 86 which at one end supports a first pulley arrangement 87 which is preferably defined by a pair of coaxially adjacent but independently rotatable pulleys. A second pulley arrangement 88 is rotatably supported adjacent the other end of the housing. This pulley arrangement 88 is also preferably defined by a pair of coaxial but independently rotatable pulleys. This pulley arrangement 88 has the support shaft 89 thereof supported with opposed horizontally elongate slots 91 formed on housing side walls, whereby pulley arrangement 88 can move horizontally toward the pulley arrangement 87. A spring arrangement 92, similar to uniform-force springs utilized in tape measures, connects to pulley arrangement 88 so as to bias it into its end position as shown.

The cable 93, as connected at one end to connector 94, extends over a guide roller 99 and then out through the bottom wall of box 51, then along a guide groove defined in a cable guide 96 which is fixed to the carriage 27. The guide 96 then directs cable 93 down and into the cable manager 85. The cable 93 then guides partially around a first pulley of arrangement 87, then extends lengthwise of the housing and wraps half way around a first pulley of arrangement 88. Cable 93 then extends back toward arrangement 87 and wraps half way around the second pulley thereof, then extends again toward arrangement 88 and wraps half way around the second pulley thereof, after which the cable 93 extends back to the entry end of the housing. At this point the cable can be anchored if desired, as by an anchor 97. However, the cable 93 extends past this anchor, passes along a second parallel guide groove formed on the cable guide 96, and then into the control box 51. This other end of the cable as fed into the control box is connected to a similar port or connector as preferably mounted on a side or back wall of the box, which latter connector can then be used for connection to the monitor in the manner previously described.

With the arrangement of FIG. 20, when the monitor is in the upright use position, indicated by dotted lines in FIG. 20, the connector 94 and associated cable 93 can be manually extended to permit direct connection to an electronic device such as a laptop computer. The extension of cable 93 causes pulley arrangement 88 to move horizontally toward the pulley arrangement 87, thereby providing adequate cable for proper extension thereof. The spring 92 returns the pulley arrangement 88, and retracts the cable 93 and connector 94, when the latter is disconnected from the user device.

While FIG. 20 shows only a single cable 93 and connector 94, it will be appreciated that at least two cables having different connectors, such audio and video connectors, will be provided. In such case, the cable manager 85 will be provided with plural side-by-side compartments, each having generally the same above-described pulley system, for cooperation with each cable.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. A table arrangement having a flat-panel video monitor integrated therewith, comprising:

a table having a table top supported on an upright leg structure, said table top defining a large horizontally-planar top surface bounded by at least one substantially straight horizontally-elongate edge;

a flat-panel video monitor integrated with said table;

a monitor support arrangement carried on said table and positioned closely adjacent but beneath said table top;

said monitor support arrangement including a monitor supporting assembly which mounts said monitor thereon and permits movement of said monitor between (1) a storage position wherein the monitor is horizontally oriented and is disposed substantially entirely under said table top adjacent an underside thereof, and (2) a use position wherein the monitor is disposed closely adjacent said one edge of said table top and projects vertically upwardly therefrom so that a front face of the monitor faces outwardly over the table top;

wherein said monitor support assembly includes:

a carriage disposed directly under said table top and horizontally movable relative thereto along a generally horizontal direction which extend substantially perpendicular to said one table edge, said carriage being movable along said direction between extended and retracted positions;

a monitor support frame having said monitor carried thereon and disposed sidewardly adjacent said carriage and oriented generally horizontally beneath said table top when the carriage is in said retracted position, wherein movement of said carriage from said retracted position into said extended position causes the monitor support frame to be moved into an intermediate transitional position wherein the monitor is still horizontally oriented but projects horizontally outwardly beyond said one table edge; and a hinge structure coupled between said carriage and said monitor support frame and defining a main horizontal hinge axis which extends substantially parallel to said one table edge for permitting vertical swinging movement of said monitor support frame about said main hinge axis between said immediate transitional position and said use position, wherein the monitor support arrangement includes a pair of generally parallel and horizontally elongate support rails fixed to the underside of said table top in sidewardly spaced relation, said rails protruding horizontally along the underside of the table top toward and terminating closely adjacent said one table edge, said support rails mounting thereon carriage guides, and said carriage extending transversely between and having opposite edges thereof movably supported on said guides for enabling movement of the carriage lengthwise along the support rails between said extended and retracted positions, said carriage protruding downwardly below the undersurface of the table top by a vertical extent which is similar in magnitude to the downward protrusion of the support rails; said monitor support frame including a plate-like member which is disposed between the support rails and is generally horizontally oriented in the storage position so as to be positioned directly adjacent and beneath the table top while located between said one table edge and said carriage, said monitor support frame extending over at least a portion of a back of the monitor and being secured thereto so that the monitor is horizontally oriented and faces upwardly toward the table top when in the storage position, wherein the monitor support frame has an accessible grip portion fixed adjacent an edge thereof remote from said carriage and positioned in the vicinity of said one table edge when the monitor support assembly is in the storage position so that a user can manually engage the grip portion and pull the monitor support assembly horizontally outwardly into the intermediate transitory position; and including guide structure fixed to said table under the table top in the vicinity of said one edge and cooperating with opposed elongated guide rails provided on said monitor support frame for maintaining the monitor support frame and a monitor mounted thereon in a substantially horizontal orientation as the monitor support frame moves between the storage and intermediate transitory positions.

* * * * *